US010527988B2

(12) United States Patent
Honda et al.

(10) Patent No.: US 10,527,988 B2
(45) Date of Patent: Jan. 7, 2020

(54) IMAGE FORMING APPARATUS FOR TONER IMAGE

(71) Applicant: FUJI XEROX CO., LTD., Tokyo (JP)

(72) Inventors: Fumiyuki Honda, Kanagawa (JP); Miho Ikeda, Kanagawa (JP); Daisuke Nakai, Kanagawa (JP); Aya Kakishima, Kanagawa (JP); Shinji Okuyama, Kanagawa (JP); Yoshiki Shimodaira, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/109,787

(22) Filed: Aug. 23, 2018

(65) Prior Publication Data

US 2019/0196376 A1 Jun. 27, 2019

(30) Foreign Application Priority Data

Dec. 27, 2017 (JP) ..... 2017-250466

(51) Int. Cl.
*G03G 15/01* (2006.01)
*G03G 15/00* (2006.01)

(52) U.S. Cl.
CPC ..... *G03G 15/50* (2013.01); *G03G 15/0142* (2013.01); *G03G 15/6585* (2013.01)

(58) Field of Classification Search
CPC .... G03G 15/01; G03G 15/0142; G03G 15/50; G03G 15/6582; G03G 15/6585; G03G 2215/019
See application file for complete search history.

(56) References Cited

U.S. PATENT DOCUMENTS

2015/0093553 A1* 4/2015 Tyagi ..... G03G 15/01 428/207
2016/0274487 A1* 9/2016 Kusakabe ..... G03G 15/6585
2017/0277106 A1* 9/2017 Baba ..... G03G 15/6582
2017/0371261 A1* 12/2017 Takino ..... G03G 15/6585
2018/0113401 A1* 4/2018 Kawasaki ..... G03G 15/6585
2018/0164709 A1* 6/2018 Taguchi ..... G03G 15/6585

FOREIGN PATENT DOCUMENTS

JP 2015064401 4/2015

* cited by examiner

*Primary Examiner* — Sophia S Chen
(74) *Attorney, Agent, or Firm* — JCIPRNET

(57) ABSTRACT

An image forming apparatus includes a transfer unit that transfers a toner image to a recording medium; a non-white toner image forming unit that forms a non-white toner image on the transfer unit by using non-white toner having a non-white color that differs from white; a white toner image forming unit that forms a white toner image on the transfer unit by using white toner that is white in color after the non-white toner image is formed on the transfer unit; and a control unit that controls an amount of the white toner used by the white toner image forming unit to form the white toner image so that the amount of the white toner is smaller when the non-white toner image is formed under the white toner image than when no toner image is formed under the white toner image.

9 Claims, 6 Drawing Sheets

FIG. 5

| TYPE OF TONER IMAGE / AMOUNT OF TONER IN BACKGROUND | 100 | 92 | 80 |
|---|---|---|---|
| BLACK TONER IMAGE (WHITE TONER IMAGE AS BACKGROUND) | POOR | FAIR | GOOD |
| CYAN TONER IMAGE (WHITE TONER IMAGE AS BACKGROUND) | POOR | GOOD | GOOD |
| MAGENTA TONER IMAGE (WHITE TONER IMAGE AS BACKGROUND) | GOOD | GOOD | GOOD |
| CYAN AND MAGENTA TONER IMAGES (WHITE TONER IMAGE AS BACKGROUND) | GOOD | GOOD | GOOD |
| WHITE TONER IMAGE (BLACK TONER IMAGE AS BACKGROUND) | GOOD | GOOD | — |

IMAGE FORMING APPARATUS FOR TONER IMAGE

CROSS-REFERENCE TO RELATED APPLICATIONS

This application is based on and claims priority under 35 USC 119 from Japanese Patent Application No. 2017-250466 filed Dec. 27, 2017.

BACKGROUND

Technical Field

The present invention relates to an image forming apparatus.

SUMMARY

According to an aspect of the invention, there is provided an image forming apparatus including a transfer unit that transfers a toner image to a recording medium; a non-white toner image forming unit that forms a non-white toner image on the transfer unit by using non-white toner having a non-white color that differs from white; a white toner image forming unit that forms a white toner image on the transfer unit by using white toner that is white in color after the non-white toner image is formed on the transfer unit; and a control unit that controls an amount of the white toner used by the white toner image forming unit to form the white toner image on the transfer unit so that the amount of the white toner is smaller when the non-white toner image is formed under the white toner image on the transfer unit than when no toner image is formed under the white toner image.

BRIEF DESCRIPTION OF THE DRAWINGS

An exemplary embodiment of the present invention will be described in detail based on the following figures, wherein:

FIG. 5 is a table showing the result of Example 1; and

DETAILED DESCRIPTION

An exemplary embodiment of the present invention will now be described in detail with reference to the accompanying drawings.

Description of Image Forming Apparatus

Figure 1:
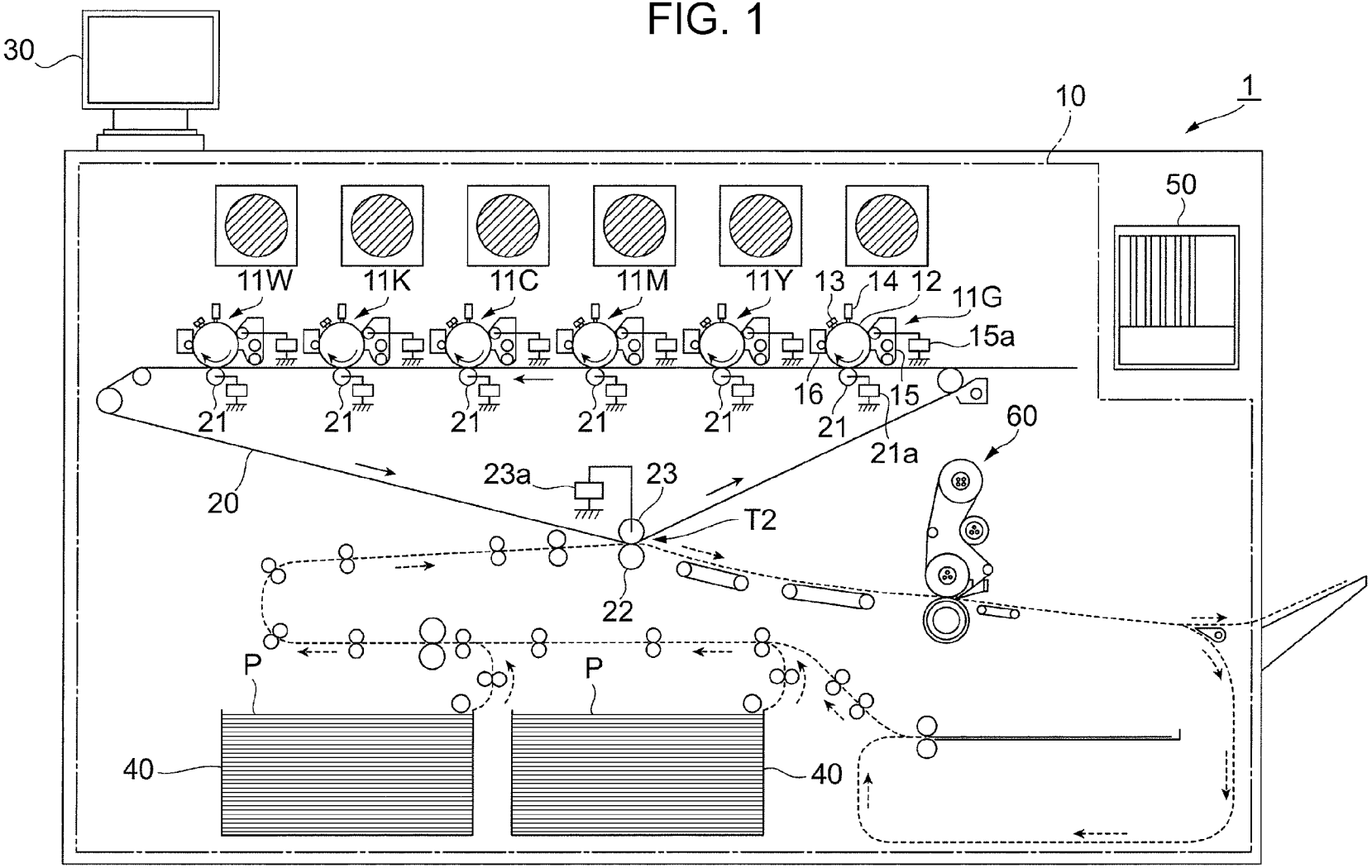
FIG. 1 is a schematic diagram illustrating an image forming apparatus according to an exemplary embodiment.

FIG. 1 is a schematic diagram illustrating an image forming apparatus 1 according to the present exemplary embodiment.

The image forming apparatus 1 illustrated in FIG. 1 is a so-called tandem color printer, and includes an image forming section 10, a controller 50, and a user interface 30. The image forming section 10 forms an image based on image data. The controller 50 is an example of a control unit which, for example, provides overall operation control of the image forming apparatus 1 and communication with a personal computer or the like and performs image processing on the image data. The user interface 30 receives operation inputs from the user and displays various information for the user.

Description of Image Forming Section

The image forming section 10 is, for example, a functional unit that forms an image by using an electrophotographic system, and includes six image forming units, which are a metallic-colored (G) image forming unit 11G, a yellow (Y) image forming unit 11Y, a magenta (M) image forming unit 11M, a cyan (C) image forming unit 11C, a black (K) image forming unit 11K, and a white (W) image forming unit 11W.

In the following description, the image forming units are generically referred to as "image forming units 11" when they are not distinguished from each other.

Each image forming unit 11 includes, for example, a photoconductor drum 12 on which an electrostatic latent image is formed and then developed into a toner image of a corresponding color; a charging device 13 that charges the surface of the photoconductor drum 12 to a predetermined potential; an exposure device 14 that irradiates the photoconductor drum 12 charged by the charging device 13 with light based on image data; a developing unit 15 that develops the electrostatic latent image formed on the photoconductor drum 12 by using toner of the corresponding color; and a cleaner 16 that cleans the surface of the photoconductor drum 12 after a transfer process. The image forming units 11 have substantially the same structure except for toners contained in the developing units 15 thereof.

In the present exemplary embodiment, each developing unit 15 contains two-component developer containing toner charged to a negative polarity and carrier composed of metal powder and charged to a positive polarity. The developing unit 15 is connected to a developing-voltage power supply 15*a* that applies a predetermined developing voltage to the developing unit 15. When the developing-voltage power supply 15*a* applies the developing voltage to the developing unit 15, a toner developing electric field is generated between the developing unit 15 and the photoconductor drum 12. The developing unit 15 transfers the toner on the developing unit 15 to a latent-image region on the photoconductor drum 12 by using the developing electric field.

The image forming section 10 also includes a transfer belt 20 to which the toner images of respective colors formed on the photoconductor drums 12 of the image forming units 11 are transferred, and first transfer rollers 21 that transfer the toner images of the respective colors formed by the image forming units 11 onto the transfer belt 20 (first transfer process). The image forming section 10 also includes a second transfer roller 22 that simultaneously transfers the toner images of the respective colors that have been transferred to the transfer belt 20 in a superposed manner onto a paper sheet P, which is an example of a recording medium (second transfer process); an opposing roller 23 that faces the second transfer roller 22 with the transfer belt 20 interposed therebetween; and a fixing unit 60 that fixes the toner images of the respective colors that have been transferred to the paper sheet P in the second transfer process to the paper sheet P.

In the present exemplary embodiment, a region in which the second transfer roller 22 is disposed and in which the toner images of the respective colors on the transfer belt 20 are transferred onto the paper sheet P in the second transfer process is hereinafter referred to as a second transfer region T2.

Each first transfer roller 21 is connected to a first-transfer-voltage power supply 21*a* that applies a first transfer voltage to the first transfer roller 21, the first transfer voltage having a polarity opposite to the polarity to which the toner is charged (positive polarity in this example). When the first-transfer-voltage power supply 21*a* applies the predetermined first transfer voltage to the first transfer roller 21, a transfer electric field is generated between the first transfer roller 21 and the corresponding photoconductor drum 12. The first transfer roller 21 causes the toner image on the photoconductor drum 12 to transfer to the transfer belt 20 in the first transfer process by using the transfer electric field.

The opposing roller 23 is connected to a second-transfer-voltage power supply 23*a* that applies a second transfer voltage to the opposing roller 23, the second transfer voltage having the same polarity as the polarity to which the toner is charged (negative polarity in this example). When the second-transfer-voltage power supply 23*a* applies the predetermined second transfer voltage to the opposing roller 23, a transfer electric field is generated between the opposing roller 23 and the second transfer roller 22. The second transfer roller 22 causes the toner images on the transfer belt 20 to transfer to the paper sheet P in the second transfer process by using the transfer electric field.

In the present exemplary embodiment, the transfer belt 20, the first transfer rollers 21, and the second transfer roller 22 function as a transfer unit.

In the present exemplary embodiment, the metallic-colored image forming unit 11G, the yellow image forming unit 11Y, the magenta image forming unit 11M, the cyan image forming unit 11C, the black image forming unit 11K, and the white image forming unit 11W are arranged in that order in a rotation direction in which the transfer belt 20 rotates (counterclockwise in FIG. 1) from an upstream side to a downstream side with respect to the second transfer region T2. In particular, in the rotation direction of the transfer belt 20, the white image forming unit 11W is located most downstream with respect to the second transfer region T2.

Description of Image Forming Operation

A basic image forming operation performed by the image forming apparatus 1 according to the present exemplary embodiment will now be described.

The image forming units 11 of the image forming section 10 form toner images of the respective colors, which are metallic color, yellow, magenta, cyan, black, and white by an electrophotographic process in which the above-described functional components are used. The toner images of the respective colors formed by the image forming units 11 are successively transferred onto the transfer belt 20 by the first transfer rollers 21 in the first transfer process to form a combined toner image in which the toner images of the respective colors are superposed. The combined toner image on the transfer belt 20 is transported to the second transfer region T2, in which the second transfer roller 22 is disposed, by the movement of the transfer belt 20 in the direction indicated by the arrows.

A paper-sheet transporting system transports the paper sheet P, which is fed from one of paper sheet containers 40 by a feed roller, along a transport path to the second transfer region T2. In the second transfer region T2, the combined toner image on the transfer belt 20 is transferred onto the paper sheet P by the transfer electric field generated between the second transfer roller 22 and the opposing roller 23 in the second transfer process.

After that, the paper sheet P to which the combined toner image has been transferred is separated from the transfer belt 20, and is transported along a transport path toward the fixing unit 60. The combined toner image on the paper sheet P that has been transported to the fixing unit 60 is fixed to the paper sheet P by a fixing process performed by the fixing unit 60.

The toner contained in each developing unit 15 according to the present exemplary embodiment will now be described.

The metallic-colored toner used in the present exemplary embodiment contains metal colorant, such as silver powder or metallic aluminum powder. The metallic color is, for example, gold or silver. The black toner used in the present exemplary embodiment contains conductive colorant, such as carbon black.

In the present exemplary embodiment, the toners in colors other than white, that is, the metallic-colored toner, the yellow toner, the magenta toner, the cyan toner, and the black toner, are generically referred to as non-white toners NT.

The white toner WT is used to form a white image on a paper sheet P that is not white (for example, black). In the region where a white toner image is formed on a non-white paper sheet P, the color of the non-white paper sheet P is not visible to the user. Therefore, when a non-white toner image is formed on a non-white paper sheet P, the white toner WT may be used to form a white toner image that serves as the background for the non-white toner image. The white toner WT used in the present exemplary embodiment has a particle diameter greater than that of any of the non-white toners NT. The particle diameter of the carrier used together with the white toner WT is also greater than that of any of the carriers used together with the non-white toners NT. The particle diameter of a toner is the volume mean diameter of particles of the toner. The particle diameter of a carrier is the volume mean diameter of particles of the carrier.

In the present exemplary embodiment, the metallic-colored image forming unit 11G, the yellow image forming unit 11Y, the magenta image forming unit 11M, the cyan image forming unit 11C, and the black image forming unit 11K each function as a non-white toner image forming unit that forms a non-white toner image by using non-white toner. The white image forming unit 11W functions as a white toner image forming unit that forms a white toner image by using white toner. The metallic-colored image forming unit 11G, the yellow image forming unit 11Y, the magenta image forming unit 11M, the cyan image forming unit 11C, the black image forming unit 11K, and the white image forming unit 11W are regarded as toner image forming units.

Figure 2:
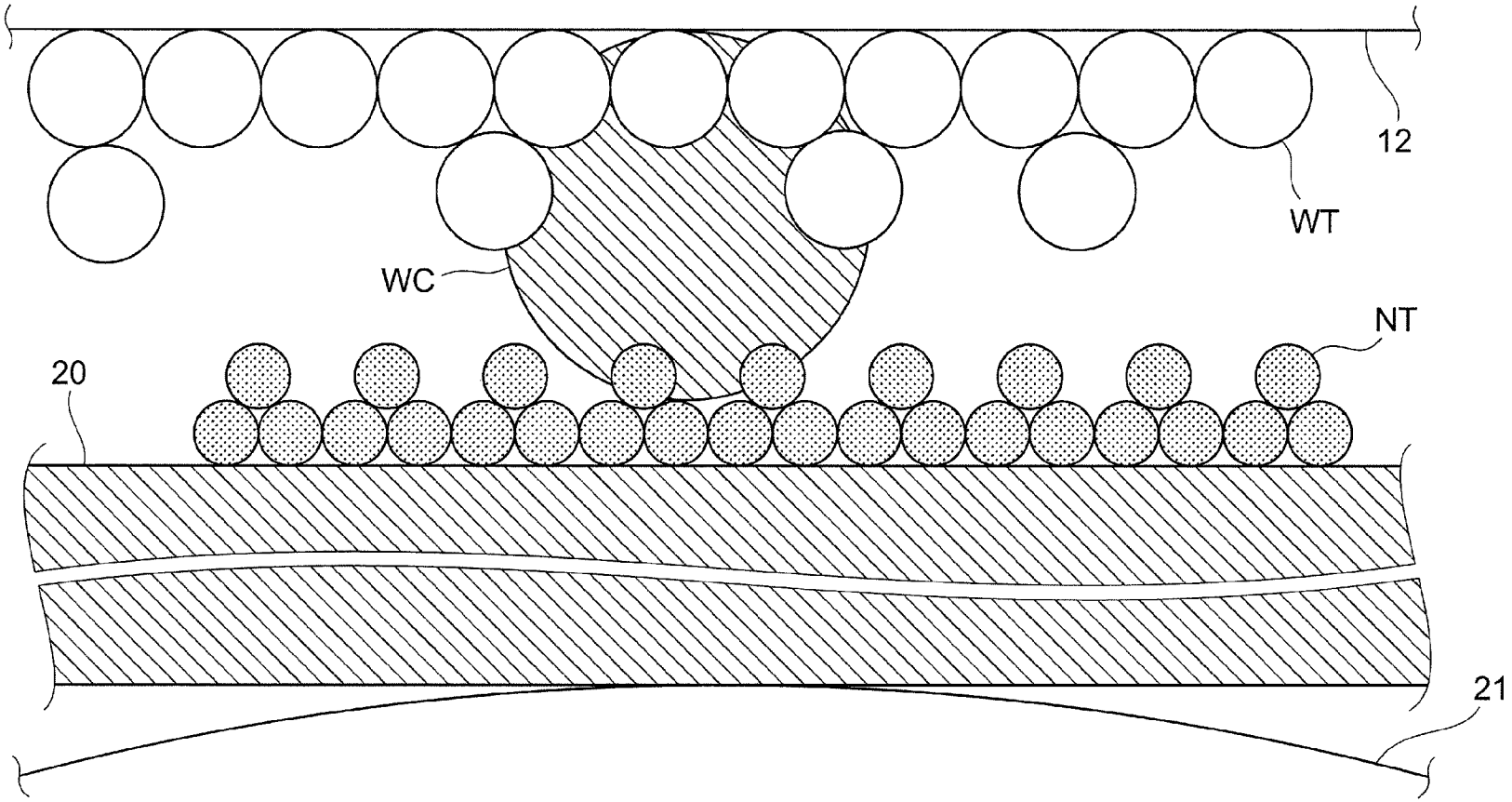
FIG. 2 is an enlarged view of a region between a photoconductor drum and a first transfer roller of a white image forming unit.

FIG. 2 is an enlarged view of a region between the photoconductor drum 12 and the first transfer roller 21 in the white image forming unit 11W.

In the case where a white toner image is formed on the paper sheet P as the background of a non-white toner image, the white toner image is formed above the non-white toner image on the transfer belt 20. Therefore, when the white image forming unit 11W forms the white toner image that serves as the background on the transfer belt 20, as illustrated in FIG. 2, the non-white toner image formed of a non-white toner NT is formed on the transfer belt 20.

The first transfer voltage is applied to the first transfer roller 21 so that a potential difference is generated between the first transfer roller 21 and the photoconductor drum 12. When the potential difference is large, there is a possibility that a current will flow from the photoconductor drum 12 to the first transfer roller 21. In other words, there is a possibility that a discharge will occur. When a current flows through the non-white toner NT on the transfer belt 20, the charge on the non-white toner NT is partially removed, and the amount of charge on the non-white toner NT is reduced. The amount of charge on the toner is the amount of charge on the toner particles.

When transferring of the non-white toner image is performed in the second transfer process while the amount of charge on the non-white toner NT is reduced, there is a risk that a portion of the non-white toner image cannot be transferred to the paper sheet P. As a result, so-called voids, which are white regions in which the non-white toner image has failed to transfer to the paper sheet P in the second transfer process, are formed.

When the developing unit 15 develops the electrostatic latent image formed on the photoconductor drum 12 by using the white toner WT, the carrier WC contained in the developing unit 15 may come into contact with and transfer to the photoconductor drum 12 (see FIG. 2). Since the carrier WC is conductive, when the carrier WC is present on the photoconductor drum 12, a current easily flows from the photoconductor drum 12 to the non-white toner NT on the transfer belt 20 through the carrier WC.

In particular, in the present exemplary embodiment, the white toner WT has a large particle diameter to increase the color-hiding performance for the paper sheet P. Accordingly, the carrier WC also has a large particle diameter. Since the carrier WC has a large particle diameter, a current easily flows from the photoconductor drum 12 over a large region, and a large amount of non-white toner NT easily allows a current to flow therethrough. Furthermore, since the non-white toner NT has a particle diameter smaller than that of the white toner WT, the amount of charge on the non-white toner NT transferred to the transfer belt 20 in the first transfer process is small. Therefore, the non-white toner NT is more difficult to transfer to the paper sheet P in the second transfer process than the white toner WT when a current flows therethrough and the amount of charge thereon is reduced. The color-hiding performance for the paper sheet P is the degree to which the color of the paper sheet P may be hidden.

In the present exemplary embodiment, the first transfer voltage is applied to the first transfer roller 21 that faces the photoconductor drum 12 in each image forming unit 11. When the non-white toner NT on the transfer belt 20 passes through each image forming unit 11, the non-white toner NT is charged by the first transfer roller 21 so that the amount of charge thereon is increased.

In the present exemplary embodiment, among the image forming units 11, the white image forming unit 11W is located most downstream with respect to the second transfer region T2 in the rotation direction of the transfer belt 20. Therefore, the non-white toner image under the white toner image do not pass through any of the image forming units 11 after the white toner image is formed above the non-white toner image on the transfer belt 20. In this case, when the amount of charge on the non-white toner NT on the transfer belt 20 is reduced in the white image forming unit 11W, the non-white toner image is transferred onto the paper sheet P in the second transfer process while the amount of charge thereon is small. As a result, voids are easily formed.

Accordingly, in the present exemplary embodiment, the amount of white toner WT in the white toner image formed on the transfer belt 20 by the white image forming unit 11W is reduced. More specifically, when a non-white toner image is formed under the white toner image on the transfer belt 20, the amount of white toner WT in the white toner image formed on the transfer belt 20 is reduced from that when no toner image is formed under the white toner image. The amount of toner is the mass of toner per unit area.

In this case, the sum of the amount of white toner WT and the amount of non-white toner NT on the transfer belt 20 is reduced, so that the intensity of the transfer electric field applied to each toner on the transfer belt 20 is increased when the toner images are transferred from the transfer belt 20 to the paper sheet P in the second transfer process. As a result, the non-white toner image is easily transferred to the paper sheet P in the second transfer process, and the occurrence of voids is reduced.

In the present exemplary embodiment, the amount of white toner WT in the white toner image formed on the transfer belt 20 is reduced by thinning the electrostatic latent image formed on the photoconductor drum 12 by the exposure device 14 to reduce the density of the white toner image developed on the photoconductor drum 12.

White Toner Amount Control Process

A process for controlling the amount of white toner WT in the white toner image formed on the transfer belt 20 (hereinafter referred to as a white toner amount control process) will now be described in detail.

Figure 3:
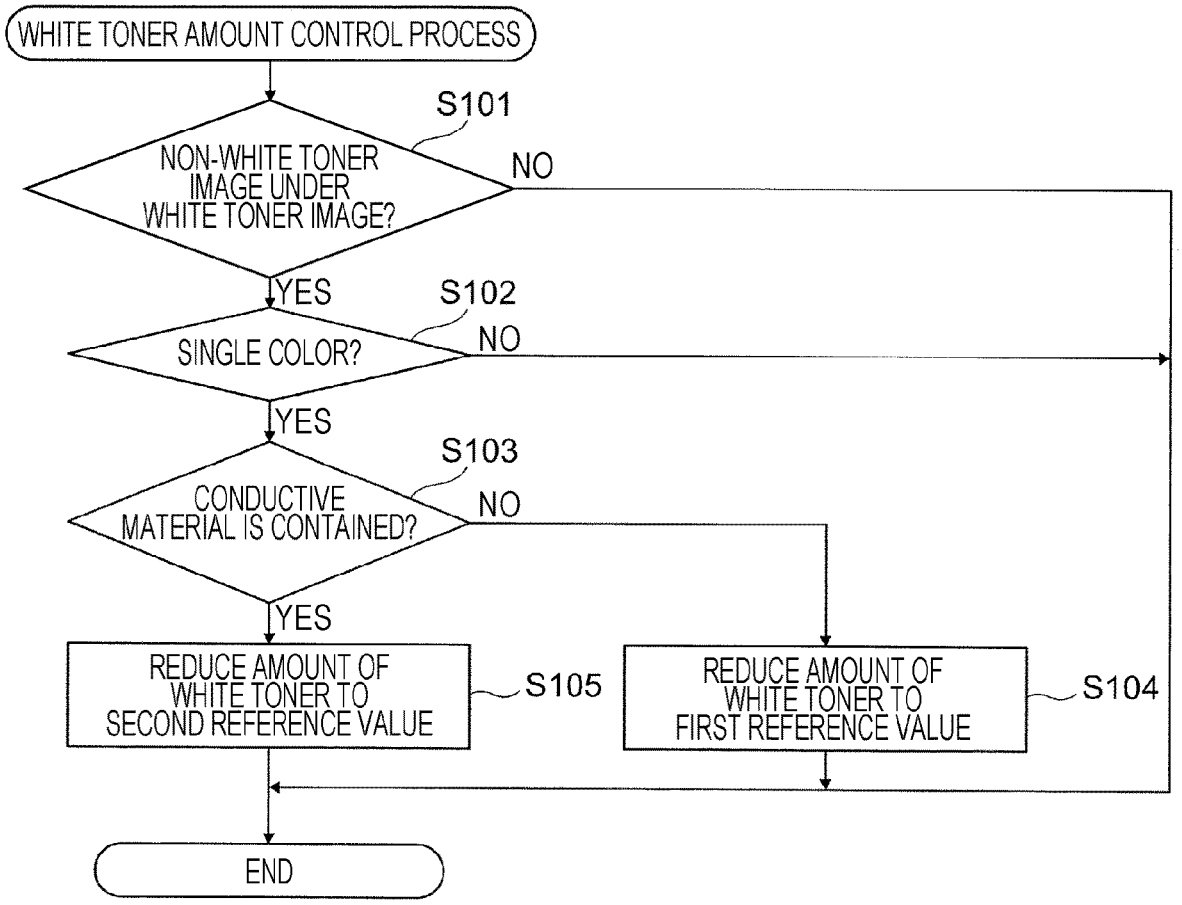
FIG. 3 is a flowchart of a white toner amount control process.

FIG. 3 is a flowchart of the white toner amount control process.

The controller 50 carries out the white toner amount control process by controlling the image forming units 11 and the transfer belt 20.

First, it is determined whether or not a non-white toner image is formed under the white toner image on the transfer belt 20 (step (hereinafter abbreviated as S) 101). When no non-white toner image is formed under the white toner image (NO in S101), the process is ended.

When a non-white toner image is formed under the white toner image (YES in S101), it is determined whether or not the non-white toner image is an image of a single color (S102). When the non-white toner image formed under the white toner image is an image of two or more colors (NO in S102), the process is ended.

When a non-white toner image of two or more colors is formed under the white toner image on the transfer belt 20, one of the non-white toners NT of the two or more colors that is located uppermost on the transfer belt 20 most easily causes a reduction in the amount of charge in the white image forming unit 11W. In other words, when a current flows from the photoconductor drum 12 (see FIG. 2) toward the first transfer roller 21 while the white toner image is being transferred in the first transfer process, the current most easily flows through one of the non-white toners NT of the two or more colors that is located uppermost on the transfer belt 20.

The non-white toner NT located uppermost on the transfer belt 20 is not in direct contact with the transfer belt 20, and is therefore easily transferred to the paper sheet P in the second transfer process. The non-white toner NT that is in direct contact with the transfer belt 20 does not easily allow the current from the photoconductor drum 12 to pass therethrough and cause a reduction in the amount of charge thereon, and is therefore easily transferred to the paper sheet P in the second transfer process. Thus, when a non-white toner image of two or more colors is formed under the white toner image on the transfer belt 20, voids are not easily formed even when the amount of charge on the non-white toners NT is reduced in the white image forming unit 11. Accordingly, in the present exemplary embodiment, when a non-white toner image of two or more colors is formed under the white toner image on the transfer belt 20, the amount of white toner WT in the white toner image is not reduced. As a result, the color-hiding performance for the paper sheet P is increased in the region in which the white toner image is formed on the paper sheet P.

When a non-white toner image of a single color is formed under the white toner image on the transfer belt 20 (YES in S102), it is determined whether or not the non-white toner NT of the single color contains a conductive material (S103). In the present exemplary embodiment, it is determined whether or not the non-white toner NT of the single color is black toner or metallic-colored toner.

When the non-white toner NT of the single color contains no conductive material (NO in S103), the amount of white toner WT in the white toner image formed on the transfer belt 20 is reduced from the amount of white toner WT in the white toner image formed on the transfer belt 20 when no toner image is formed under the white toner image (hereinafter referred to as a normal amount of white toner). More specifically, the amount of white toner WT in the white toner image formed on the transfer belt 20 is reduced to a first reference value (S104). The first reference value is, for example, 10% less than the normal amount of white toner.

When the non-white toner NT of the single color contains a conductive material (YES in S103), the amount of white toner WT in the white toner image formed on the transfer belt 20 is reduced from that in the case where no conductive material is contained. More specifically, the amount of white toner WT in the white toner image formed on the transfer belt 20 is reduced to a second reference value (S105). The second reference value is, for example, 20% less than the normal amount of white toner.

When the non-white toner NT in the non-white toner image formed under the white toner image on the transfer belt 20 contains a conductive material, a current easily flows from the photoconductor drum 12 through the non-white toner NT containing the conductive material when the white toner image is transferred in the first transfer process.

Accordingly, in the present exemplary embodiment, when the non-white toner NT contains a conductive material, the amount of white toner WT in the white toner image formed on the transfer belt 20 is reduced from that in the case where the non-white toner NT contains no conductive material. In this case, even when a current flows through the non-white toner NT containing a conductive material and the amount of charge on the non-white toner NT is reduced, the non-white toner image is easily transferred to the paper sheet P in the second transfer process.

Modification of White Toner Amount Control Process

A white toner amount control process according to a modification will now be described.

Figure 4:
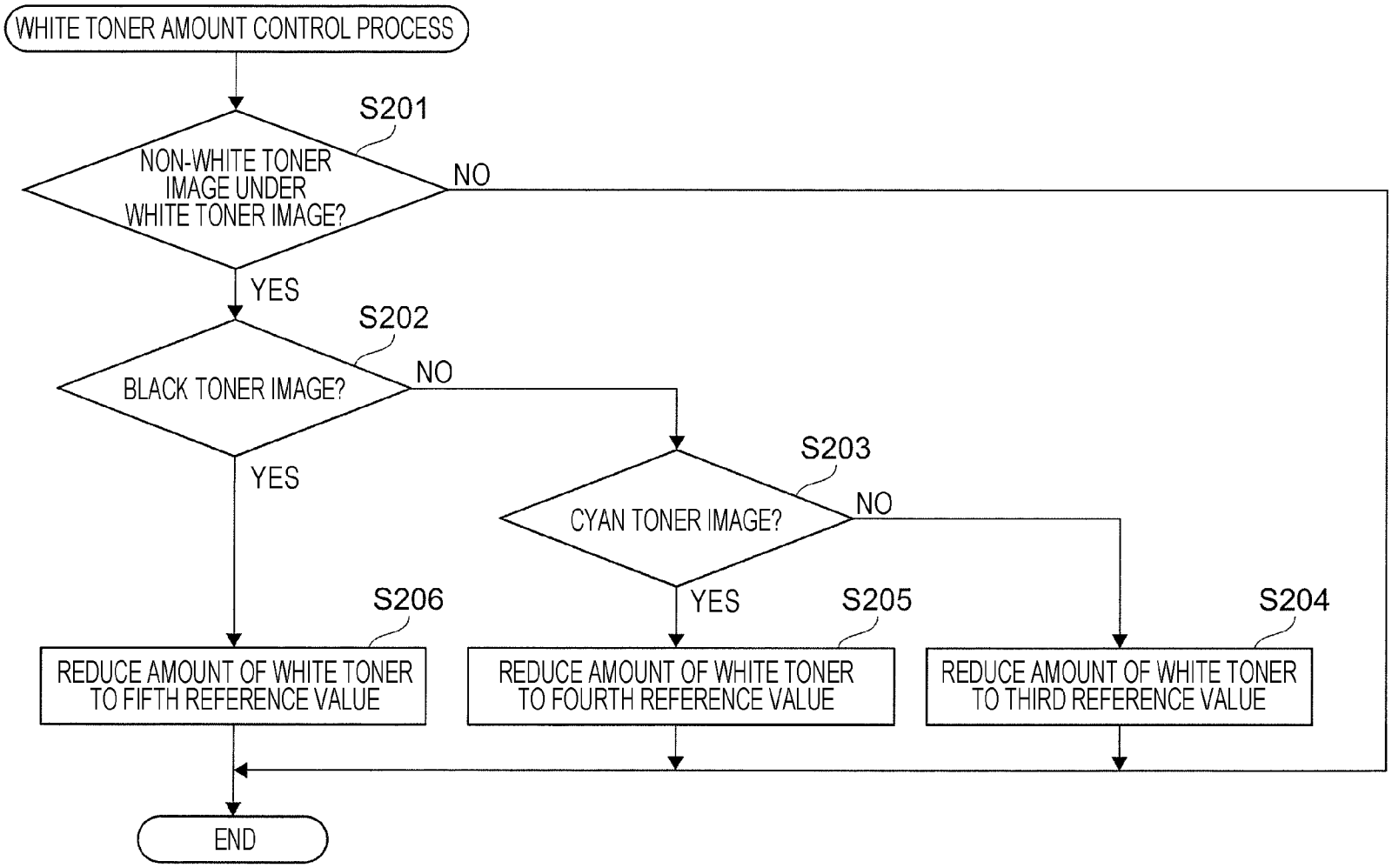
FIG. 4 is a flowchart of a white toner amount control process according to a modification.

FIG. 4 is a flowchart of a white toner amount control process according to a modification.

First, it is determined whether or not a non-white toner image is formed under the white toner image on the transfer belt 20 (S201). When no non-white toner image is formed under the white toner image (NO in S201), the process is ended.

When a non-white toner image is formed under the white toner image (YES in S201), it is determined whether or not the non-white toner image is a black toner image (S202).

When the non-white toner image is not a black toner image (NO in S202), it is determined whether or not the non-white toner image is a cyan toner image (S203).

When the non-white toner image is not a cyan toner image (NO in S203), the amount of white toner WT in the white toner image formed on the transfer belt 20 is reduced from the normal amount of white toner. More specifically, the amount of white toner WT in the white toner image formed on the transfer belt 20 is reduced to a third reference value (S204). The third reference value is, for example, 10% less than the normal amount of white toner.

When the non-white toner image is a cyan toner image (YES in S203), the amount of white toner WT in the white toner image formed on the transfer belt 20 is reduced from that when the non-white toner image is neither a black toner image nor a cyan toner image. More specifically, the amount of white toner WT in the white toner image formed on the transfer belt 20 is reduced to a fourth reference value (S205). The fourth reference value is, for example, 20% less than the normal amount of white toner.

When the non-white toner image is a black toner image (YES in S202), the amount of white toner WT in the white toner image formed on the transfer belt 20 is reduced from that when the non-white toner image is not a black toner image. More specifically, the amount of white toner WT in the white toner image formed on the transfer belt 20 is reduced to a fifth reference value (S206). The fifth reference value is, for example, 30% less than the normal amount of white toner.

When the amount of white toner WT in the white toner image that serves as the background of a non-white toner image is reduced, the color-hiding performance for the paper sheet P in the region in which the white toner image is formed on the paper sheet P is easily reduced. The black toner and cyan toner have higher color-hiding performance for the paper sheet P than the yellow toner or magenta toner. Therefore, when a black toner image or a cyan toner image is formed on the white toner image on the paper sheet P, high color-hiding performance for the paper sheet P is easily ensured even when the amount of white toner WT in the white toner image that serves as the background is reduced.

Accordingly, in the present exemplary embodiment, when a black toner image or a cyan toner image is formed under the white toner image on the transfer belt 20, the amount of white toner WT in the white toner image formed on the transfer belt 20 is reduced from that in the case where the non-white toner image formed under the white toner image is neither a black toner image nor a cyan toner image. In this case, the color-hiding performance for the paper sheet P in the region in which the white toner image is formed on the paper sheet P is easily maintained, and the occurrence of voids is further reduced.

In the present exemplary embodiment, among the image forming units 11, the black image forming unit 11K is located immediately upstream of the white image forming unit 11W with respect to the second transfer region T2. When a black toner image is formed on the transfer belt 20, the black toner on the transfer belt 20 does not newly pass through the yellow, magenta, and cyan image forming units 11, and is therefore not charged by the first transfer rollers 21. Accordingly, the amount of charge on the black toner is not increased. As a result, voids easily occur when the amount of charge on the black toner on the transfer belt 20 is reduced in the white image forming unit 11W.

Accordingly, in the present exemplary embodiment, when a black toner image is formed under the white toner image on the transfer belt 20, the amount of white toner WT in the white toner image formed on the transfer belt 20 is reduced from that in the case where the non-white toner image under the white toner image is not a black toner image. In this case, the intensity of the transfer electric field applied to each toner on the transfer belt 20 in the second transfer process is increased, so that the black toner image is easily transferred to the paper sheet P in the second transfer process even when the amount of charge on the black toner on the transfer belt 20 is not large.

Examples carried out by the inventors of the present invention will now be described.

EXAMPLE 1

In Example 1 carried out by the inventors of the present invention, a toner image that serves as the background and a toner image that is disposed on the background and has a color different from the color of the background are formed on the paper sheet P. The amount of toner in the toner image that serves as the background on the transfer belt 20 is changed, and the resulting image is evaluated for the occurrence of voids. In Example 1, a solid toner image that serves as the background and a solid toner image in another color that is disposed on the background are formed over the entire area of one side of an A3-size paper sheet P. The resulting image is rated as "poor" when the number of voids is 11 or more, "fair" when the number of voids is 1 to 10, and "good" when the number of voids is 0. The result of evaluation for the amount of toner when no image is formed is denoted by "–". The number of voids is the number of locations at which voids are visually detected on the solid image formed on the paper sheet P.

FIG. 5 is a table showing the result of Example 1, illustrating the relationship between the controlled amount of toner in the toner image formed on the transfer belt 20 as the background and the number of voids that are formed. The "type of toner image" shows the type of toner images formed on the paper sheet P, and the "amount of toner in background" shows the controlled amount of toner in the toner image formed on the transfer belt 20 as the background. A white toner image is formed on a black toner image on the paper sheet P by switching the positions of the black image forming unit 11K and the white image forming unit 11W.

FIG. 5 shows that, in the case where a magenta toner image or cyan and magenta toner images are formed on a white toner image on the paper sheet P, no voids are formed irrespective of the amount of white toner WT in the white toner image. In contrast, in the case where a black toner image or a cyan toner image is formed on a white toner image on the paper sheet P, 11 or more voids are formed when the amount of white toner WT in the white toner image is large. This is probably because the black image forming unit 11K and the cyan image forming unit 11C are disposed downstream of the magenta image forming unit 11M, and accordingly the amounts of charge on the black toner and cyan toner on the transfer belt 20 are small.

In the case where a white toner image is formed on a black toner image on the paper sheet P, no voids are formed in the white toner image irrespective of the amount of black toner in the black toner image. This shows that voids are easily formed when the white image forming unit 11W is located most downstream among the image forming units 11 with respect to the second transfer region T2 in the rotation direction of the transfer belt 20 and when a white toner image serves as the background.

In the case where a black toner image is formed on a white toner image on the paper sheet P, the number of voids decreases as the amount of white toner WT is reduced. In the case where a cyan toner image is formed on a white toner image on the paper sheet P, the number of voids is smaller when the amount of white toner WT is small than when the amount of white toner WT is large.

EXAMPLE 2

In Example 2 carried out by the inventors of the present invention, a non-white toner image is formed on a white toner image on the paper sheet P, and the amount of white toner WT in the white toner image formed on the transfer belt 20 is changed. The non-white toner image formed on the paper sheet P is evaluated for brightness. In this example, a solid white toner image and a solid non-white toner image are formed over the entire area of one side of an A3-size paper sheet P.

Figure 6:
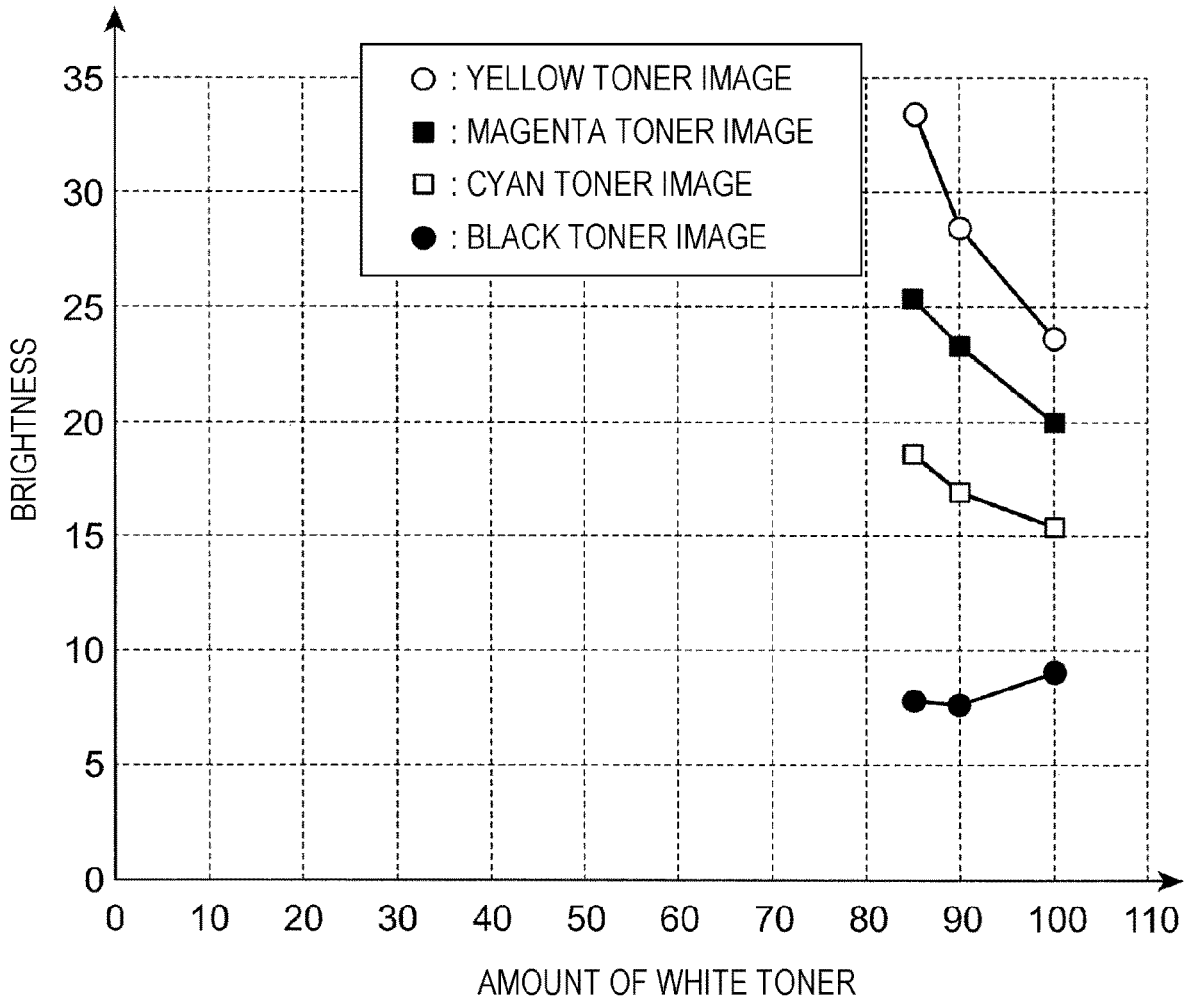
FIG. 6 is a graph showing the result of Example 2.

FIG. 6 is a graph showing the result of Example 2, illustrating the relationship between the controlled amount of white toner WT in the white toner image formed on the transfer belt 20 and the brightness of the non-white toner image.

FIG. 6 shows that the change in brightness that occurs when the amount of white toner WT in the white toner image is reduced is smaller in the black toner image and the cyan toner image than in the magenta toner image and the yellow toner image. The black toner image and the cyan toner image have higher color-hiding performance for the paper sheet P than the magenta toner image and the yellow toner image and do not easily transmit light in the color of the paper sheet P even when the amount of white toner WT is reduced, and therefore the change in brightness is small. The change in brightness that occurs when the amount of white toner WT in the white toner image is reduced is smaller in the black toner image than in the cyan toner image.

In the present exemplary embodiment, the amount of white toner WT in the white toner image formed on the transfer belt 20 is reduced when a non-white toner image of a single color is formed under the white toner image on the transfer belt 20. However, the present invention is not limited to this. For example, the amount of white toner WT in the white toner image formed on the transfer belt 20 may be left unchanged when the non-white toner image of a single color formed under the white toner image on the transfer belt 20 is a yellow toner image or a magenta toner image. Alternatively, the amount of white toner WT in the white toner image formed on the transfer belt 20 may be left unchanged when the non-white toner image of a single color formed under the white toner image on the transfer belt 20 is neither a black toner image nor a cyan toner image.

Alternatively, the amount of white toner WT in the white toner image formed on the transfer belt 20 may be left unchanged when the non-white toner image of a single color is formed under the white toner image on the transfer belt 20 by an image forming unit 11 located upstream of the white image forming unit 11W with respect to the second transfer region T2 with two or more image forming units 11 disposed therebetween. In other words, the amount of white toner WT in the white toner image formed on the transfer belt 20 may be reduced when the non-white toner image of a single color is formed under the white toner image on the transfer belt 20 by the first or second image forming unit 11 from the white image forming unit 11W on the upstream side of the white image forming unit 11W with respect to the second transfer region T2.

When, for example, the non-white toner image of a single color formed under the white toner image on the transfer belt 20 is a black toner image or a cyan toner image, it is not necessary that the amount of white toner WT in the white toner image formed on the transfer belt 20 be reduced from that when the non-white toner image of a single color is neither a black toner image nor a cyan toner image.

In the present exemplary embodiment, the amount of white toner WT in the white toner image formed on the transfer belt 20 is reduced by thinning the electrostatic latent image formed on the photoconductor drum 12. However, the present invention is not limited to this. For example, the amount of white toner WT in the white toner image formed on the transfer belt 20 may instead be reduced by reducing the developing voltage applied to the developing unit 15 to reduce the density of the white toner image developed on the photoconductor drum 12. Alternatively, for example, the amount of white toner WT in the white toner image transferred from the photoconductor drum 12 to the transfer belt 20 in the first transfer process may be reduced by reducing the transfer voltage applied to the first transfer roller 21.

In addition, although a non-white paper sheet P is used as the recording medium in the present exemplary embodiment, the recording medium is not limited to this. For example, the recording medium may instead be a resin sheet or a resin film.

The cyan toner or magenta toner used in present exemplary embodiment may contain conductive carbon.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer unit that transfers a toner image to a recording medium;

a non-white toner image forming unit that forms a non-white toner image on the transfer unit by using non-white toner having a non-white color that differs from white;

a white toner image forming unit that forms a white toner image on the transfer unit by using white toner that is white in color after the non-white toner image is formed on the transfer unit; and a control unit that controls an amount of the white toner used by the white toner image forming unit to form the white toner image on the transfer unit so that the amount of the white toner is smaller when the non-white toner image is formed under the white toner image on the transfer unit than when no toner image is formed under the white toner image, wherein a particle diameter of the white toner is greater than a particle diameter of the non-white toner.

2. The image forming apparatus according to claim 1, wherein the control unit controls the amount of the white toner so that the amount of the white toner is smaller when the non-white toner image of a single color is formed under the white toner image on the transfer unit than when no toner image is formed under the white toner image.

3. The image forming apparatus according to claim 2, wherein the control unit controls the amount of the white toner so that the amount of the white toner is smaller when the non-white toner in the non-white toner image of the single color formed under the white toner image contains a conductive material than when no conductive material is contained.

4. The image forming apparatus according to claim 3, wherein the non-white toner containing the conductive material is black toner that is black in color.

5. The image forming apparatus according to claim 1, wherein the non-white toner image formed under the white toner image on the transfer unit is a black toner image that is black in color or a cyan toner image that is cyan in color.

6. The image forming apparatus according to claim 1, wherein the image forming apparatus includes three or more toner image forming units including the non-white toner image forming unit and the white toner image forming unit, the toner image forming units individually forming toner images on the transfer unit so that the toner images are superposed, and wherein, among the toner image forming units, the white toner image forming unit is located most downstream with respect to the transfer unit.

7. The image forming apparatus according to claim 6, wherein the non-white toner image forming unit that forms the non-white toner image of the single color under the white toner image is located immediately upstream of the white toner image forming unit with respect to the transfer unit.

8. The image forming apparatus according to claim 1, wherein an amount of charge on the non-white toner is easily reduced in the white toner image forming unit.

9. The image forming apparatus according to claim 8, wherein the white toner image forming unit uses two-component developer containing toner and carrier, and wherein the amount of charge on the non-white toner is easily reduced as a result of a current flowing from the white toner image forming unit to the non-white toner through the carrier used by the white toner image forming unit.

* * * * *